US010414169B2

(12) United States Patent
Ito

(10) Patent No.: US 10,414,169 B2
(45) Date of Patent: Sep. 17, 2019

(54) PRINTER, PRINTING SYSTEM, METHOD OF PRINTING CONTROL, AND STORAGE MEDIUM

(71) Applicant: CASIO COMPUTER CO., LTD., Tokyo (JP)

(72) Inventor: Masaki Ito, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 2 days.

(21) Appl. No.: 15/933,250

(22) Filed: Mar. 22, 2018

(65) Prior Publication Data

US 2018/0272747 A1 Sep. 27, 2018

(30) Foreign Application Priority Data

Mar. 24, 2017 (JP) ..... 2017-058585

(51) Int. Cl.

| | |
|---|---|
| ***B41J 2/355*** | (2006.01) |
| ***B41J 11/00*** | (2006.01) |
| ***B41J 2/32*** | (2006.01) |
| ***B41J 3/407*** | (2006.01) |

(52) U.S. Cl.

CPC ..... *B41J 2/3555* (2013.01); *B41J 2/32* (2013.01); *B41J 2/3551* (2013.01); *B41J 3/4075* (2013.01); *B41J 11/003* (2013.01)

(58) Field of Classification Search

CPC ..... B41J 2/3551; B41J 2/3555; B41J 11/003
See application file for complete search history.

(56) References Cited

U.S. PATENT DOCUMENTS 6,195,110 B1 * 2/2001 Kokubo ..... B41J 2/3551 347/180
2005/0219345 A1 * 10/2005 Muto ..... B41J 2/355 347/180

FOREIGN PATENT DOCUMENTS

| | | | |
|---|---|---|---|
| JP | H9-187977 | A | 7/1997 |
| JP | 2003-251846 | A | 9/2003 |
| JP | 2012-121332 | A | 6/2012 |
| JP | 2013-22925 | A | 2/2013 |

* cited by examiner

*Primary Examiner* — Kristal Feggins
*Assistant Examiner* — Kendick X Liu
(74) *Attorney, Agent, or Firm* — Chen Yoshimura LLP

(57) ABSTRACT

A printer includes a processor and a thermal head having a plurality of heating elements to print an image having a plurality of print lines on a printing medium on the basis of printing data, wherein in an initial control period, for any printing data, the processor causes the thermal head to perform a division printing for each of the print lines that are to be printed in the control period, the division printing being such that for each print line to be printed, the plurality of heating elements are divided into a plurality of subgroups and the respective subgroups of the heating elements are activated in a time-divided manner, and wherein in a normal period after the control period, the processor causes the thermal head performs a non-division printing for at least some of the print lines that are to be printed in the normal period.

8 Claims, 9 Drawing Sheets

PRINTER, PRINTING SYSTEM, METHOD OF PRINTING CONTROL, AND STORAGE MEDIUM

BACKGROUND OF THE INVENTION

The present invention relates to a printer, a printing system including the printer, a method of printing control using the printer, and a storage medium for use in a processor of the printer or the printing system.

DESCRIPTION OF THE RELATED ART

One type of conventionally well-known printers prints on a printing medium one printing line at a time (on a per-print line basis) by controlling current passing through a plurality of heating elements arranged on a thermal head while conveying the printing medium.

This type of printer employs a printing scheme of printing on the printing medium by using heat from the heating elements (which generate heat when current is passed therethrough) to transfer ink from an ink ribbon onto the printing medium.

Moreover, one conventionally used technology for avoiding breakage of the ink ribbon involves "preheating" in which the thermal head is preliminarily heated prior to printing (see Japanese Patent Application Laid-Open Publication No. 2012-121332 and Japanese Patent Application Laid-Open Publication No. 2003-251846, for example).

Furthermore, when the thermal head undergoes a rapid temperature change from a high temperature to a low temperature, a phenomenon known as "sticking" in which the ink ribbon adheres to the thermal head tends to occur.

SUMMARY OF THE INVENTION

Accordingly, the present invention is directed to a scheme that substantially obviates one or more of the problems due to limitations and disadvantages of the related art.

One aspect of the present invention aims to provide a printer, a printing system, a method of printing control, and a storage medium which make it possible to prevent breakage of the ink ribbon using a simple control scheme.

Additional or separate features and advantages of the invention will be set forth in the descriptions that follow and in part will be apparent from the description, or may be learned by practice of the invention.

The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a printer, including: a thermal head having a plurality of heating elements to print an image constituted of a plurality of print lines on a printing medium line by line on the basis of printing data; and a processor, wherein the processor performs the following: defining a control period from a start of printing and a normal period after the control period; and controlling the thermal head such that: in the control period, for any printing data, the thermal head performs a division printing for each of the print lines that are to be printed in the control period, the division printing being such that for each print line to be printed, the plurality of heating elements are divided into a plurality of subgroups and the respective subgroups of the heating elements are activated in a time-divided manner; and in the normal period, the thermal head performs a non-division printing for at least some of the print lines that are to be printed in the normal period, the non-division printing being such that for each print line to be printed, corresponding heating elements of the thermal head are activated at once.

In another aspect, the present disclosure provides a printing system, including: a printer; and a printing controller, wherein the printer includes a thermal head having a plurality of heating elements to print an image constituted of a plurality of print lines on a printing medium line by line on the basis of printing data, and wherein the printing controller performs the following: defining a control period from a start of printing and a normal period after the control period; and controlling the thermal head such that: in the control period, for any printing data, the thermal head performs a division printing for each of the print lines that are to be printed in the control period, the division printing being such that for each print line to be printed, the plurality of heating elements are divided into a plurality of subgroups and the respective subgroups of the heating elements are activated in a time-divided manner; and in the normal period, the thermal head performs a non-division printing for at least some of the print lines that are to be printed in the normal period, the non-division printing being such that for each print line to be printed, corresponding heating elements of the thermal head are activated at once.

In another aspect, the present disclosure provides a method of printing control performed by a processor in a printer including the processor and a thermal head having a plurality of heating elements, or by a printing controller that controls a printer including a thermal head having a plurality of heating elements, to print an image constituted of a plurality of print lines on a printing medium line by line on the basis of printing data, the method including: defining a control period from a start of printing and a normal period after the control period; and controlling the thermal head such that: in the control period, for any printing data, the thermal head performs a division printing for each of the print lines that are to be printed in the control period, the division printing being such that for each print line to be printed, the plurality of heating elements are divided into a plurality of subgroups and the respective subgroups of the heating elements are activated in a time-divided manner; and in the normal period, the thermal head performs a non-division printing for at least some of the print lines that are to be printed in the normal period, the non-division printing being such that for each print line to be printed, corresponding heating elements of the thermal head are activated at once.

In another aspect, the present disclosure provides a non-transitory computer-readable storage medium having stored thereon a program executable by a processor in a printer including the processor and a thermal head having a plurality of heating elements, or by a printing controller that controls a printer including a thermal head having a plurality of heating elements, to print an image constituted of a plurality of print lines on a printing medium line by line on the basis of printing data, the program causing the processor or the printing controller to perform the following: defining a control period from a start of printing and a normal period after the control period; and controlling the thermal head such that: in the control period, for any printing data, the thermal head performs a division printing for each of the print lines that are to be printed in the control period, the division printing being such that for each print line to be printed, the plurality of heating elements are divided into a plurality of subgroups and the respective subgroups of the heating elements are activated in a time-divided manner; and in the normal period, the thermal head performs a non-division printing for at least some of the print lines that are to be printed in the normal period, the non-division printing being such that for each print line to be printed, corresponding heating elements of the thermal head are activated at once.

It is to be understood that both the foregoing general description and the following detailed description are exemplary and explanatory, and are intended to provide further explanation of the invention as claimed.

DETAILED DESCRIPTION OF THE INVENTION

Next, a printer, a printing system, a method of controlling the printer, and a program according to an embodiment of the present invention will be described with reference to figures.

Figure 1:
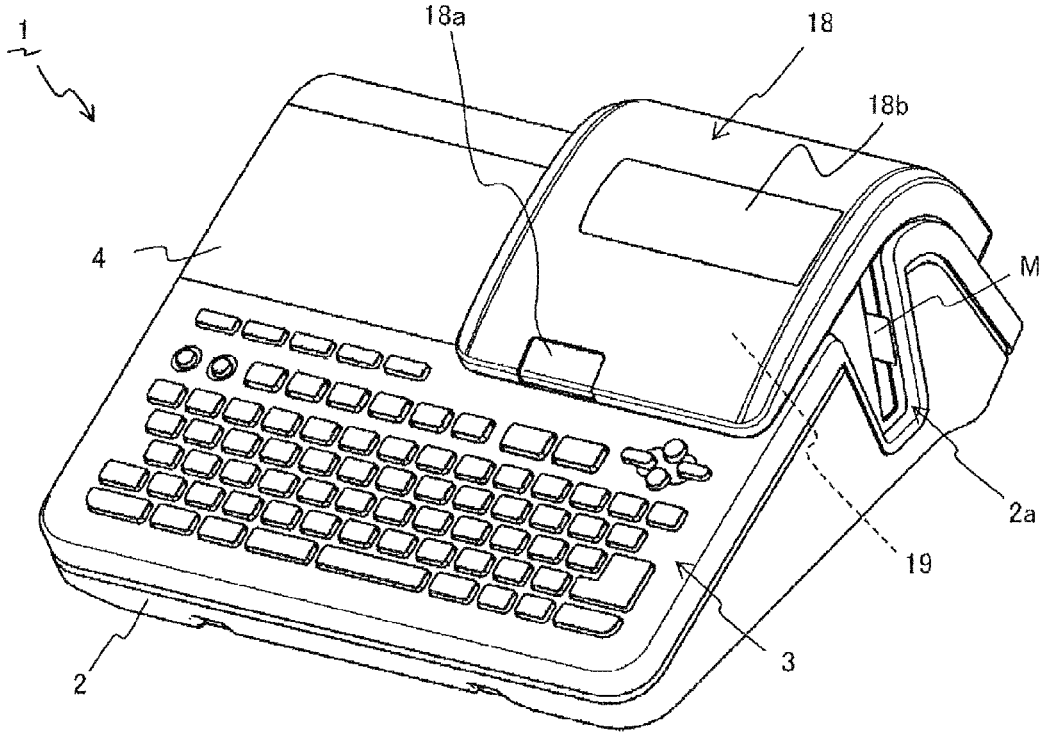
FIG. 1 is a perspective view illustrating a printer according to an embodiment.

FIG. 1 is a perspective view illustrating a printer 1 according to the embodiment.

The printer 1 is a label printer which prints on an elongated printing medium M using a single-pass scheme, for example. Although the following description describes a thermal transfer label printer which uses an ink ribbon as an example, the printing scheme and the shape of the printing medium M are not particularly limited. For example, a printing scheme which involves printing on thermal paper may be used.

Figure 2:
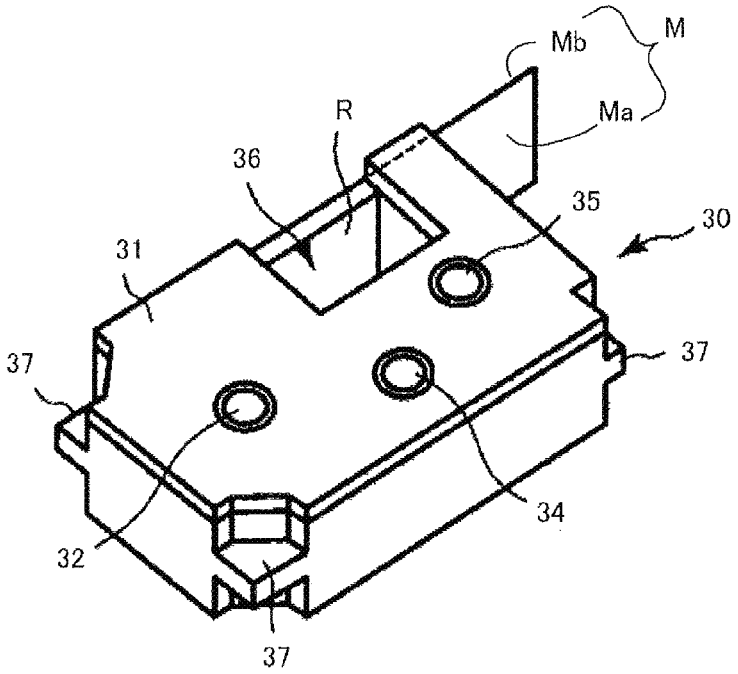
FIG. 2 is a perspective view illustrating a cassette to be housed in the printer according to the embodiment.

As illustrated in FIG. 2, the printing medium M is a tape including a base material Ma which has an adhesive layer, and a release paper Mb which is peelably adhered to the base material Ma so as to cover the adhesive layer, for example. The printing medium M may also be constituted by a single member (such as the base material Ma) which does not have release paper.

As illustrated in FIG. 1, the printer 1 includes a housing 2, an input unit 3, a display unit 4, an opening/closing lid 18, and a cassette compartment 19. The input unit 3, the display unit 4, and the opening/closing lid 18 are arranged on the top surface of the housing 2. Moreover, the housing 2 includes various components that are not illustrated in the figure, such as a power cord connection terminal, an external device connection terminal, and a storage media insertion port.

The input unit 3 includes various keys such as input keys, directional keys, conversion keys, and an enter key. The display unit 4 is a liquid crystal display panel, for example, and displays text and the like corresponding to input from the input unit 3, selection menus for various settings, messages related to various processes, and the like. Moreover, in printing, the display unit 4 displays content (hereinafter, "printing content") such as text and graphics which was specified to be printed on the printing medium M and may also display the progress of the printing process. Furthermore, the display unit 4 may include a touch panel unit, in which case the display unit 4 may be regarded as being part of the input unit 3.

The opening/closing lid 18 is arranged above the cassette compartment 19 and covers the cassette compartment 19 in an openable/closable manner. The opening/closing lid 18 can be opened by pressing a button 18*a*. A window 18*b* is formed in the opening/closing lid 18 in order to make it possible to visually check whether a cassette 30 (see FIG. 2) is currently housed in the cassette compartment 19 even when the opening/closing lid 18 is closed. Moreover, a feedout port 2*a* is formed in the side face of the housing 2. The printing medium M that is printed on inside of the printer 1 is fed to outside of the device via this feedout port 2*a*.

FIG. 2 is a perspective view illustrating the cassette 30 to be housed in the printer 1.

Figure 3:
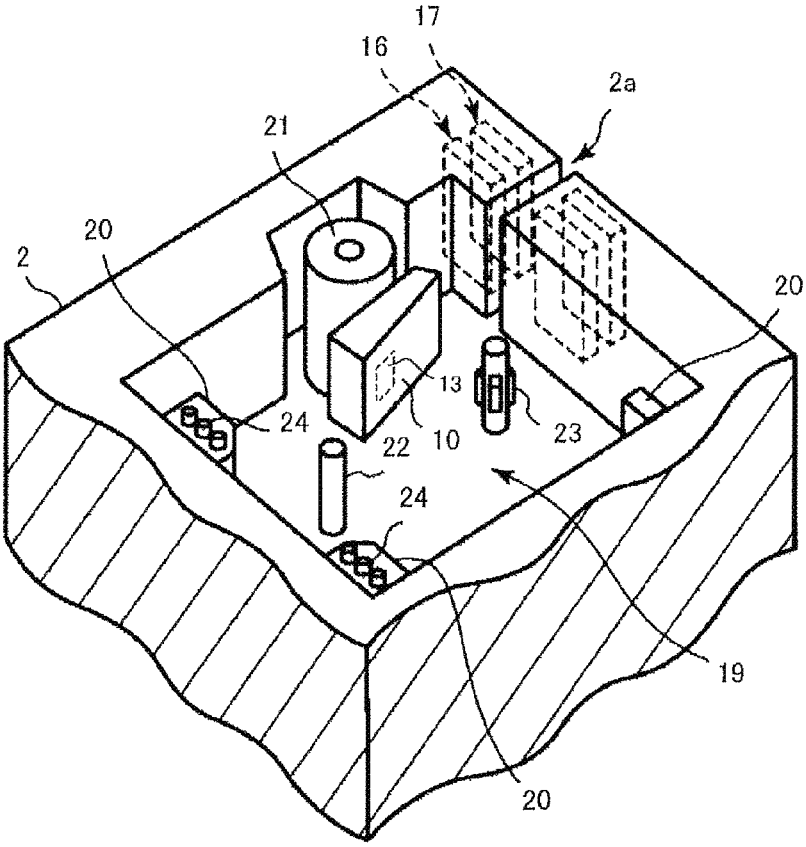
FIG. 3 is a perspective view illustrating a cassette compartment in the printer according to the embodiment.

FIG. 3 is a perspective view illustrating the cassette compartment 19 in the printer 1.

Figure 4:
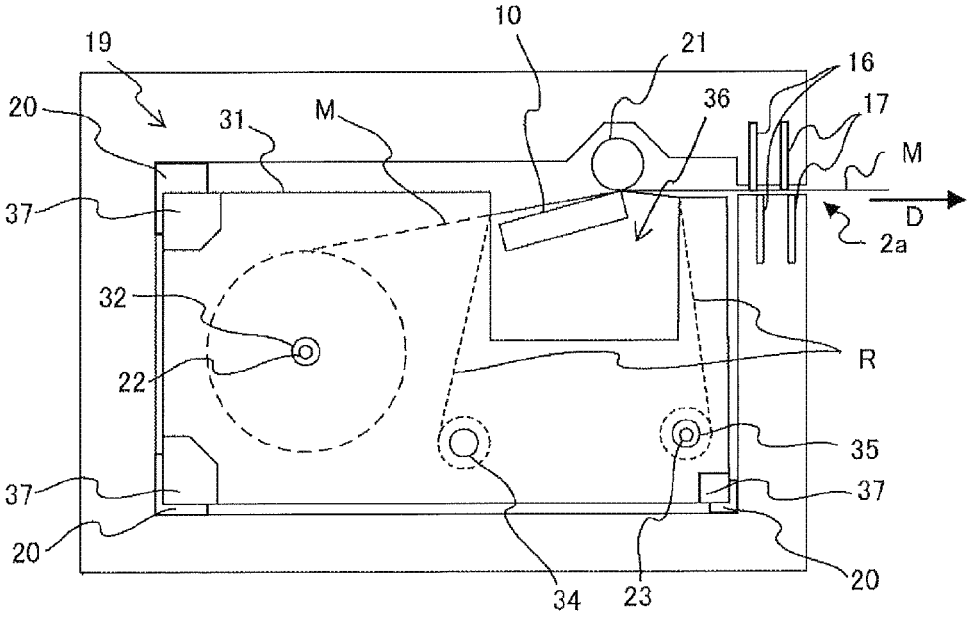
FIG. 4 is a cross-sectional view illustrating the cassette compartment in the printer according to the embodiment.

FIG. 4 is a cross-sectional view illustrating the cassette compartment 19 in the printer 1.

The cassette 30 illustrated in FIG. 2 stores the printing medium M and is removably housed within the cassette compartment 19 illustrated in FIG. 3. FIG. 4 depicts a state in which the cassette 30 is currently housed within the cassette compartment 19. As illustrated in FIG. 2, the cassette 30 includes a cassette case 31 which stores the printing medium M and an ink ribbon R and in which a thermal head insertion portion 36 and engagement portions 37 are formed.

Furthermore, the cassette case 31 includes a tape core 32, an ink ribbon supply core 34, and an ink ribbon winding core 35. The printing medium M is wound in a roll around the tape core 32 inside of the cassette case 31. Moreover, the thermal transfer ink ribbon R is wound in a roll around the ink ribbon supply core 34 inside of the cassette case 31, with the leading end being wound around the ink ribbon winding core 35.

As illustrated in FIG. 3, a plurality of cassette-receiving portions 20 for supporting the cassette 30 at prescribed positions are formed inside of the cassette compartment 19 in the housing 2. Moreover, tape width detection switches 24 (an example of a width detector for detecting the width of the printing medium M) are provided on the cassette-receiving portions 20. The cassette compartment 19 can selectively house any of various types of cassettes 30 storing printing mediums M of different widths, and therefore the tape width detection switches 24 detect the width of the printing medium M on the basis of the shape of the cassette 30 (that is, the shape of the protrusions and recesses formed in the cassette 30) and output a sensor signal indicating the detected width of the printing medium M.

Furthermore, a thermal head 10 which prints on the printing medium M, a platen roller 21 which conveys the printing medium M, a tape core-engaging axle 22, and an ink ribbon winding driver axle 23 are arranged inside of the cassette compartment 19. In addition, thermistors 13 are embedded in the thermal head 10. The thermistors 13 are an example of a head temperature measuring unit which measures the temperature of the thermal head 10.

As illustrated in FIG. 4, when the cassette 30 is housed within the cassette compartment 19, the engagement portions 37 formed in the cassette case 31 are supported by the cassette-receiving portions 20 formed in the cassette compartment 19, and the thermal head 10 is inserted into the thermal head insertion portion 36 formed in the cassette case 31. Moreover, the tape core 32 of the cassette 30 is fitted onto the tape core-engaging axle 22, and the ink ribbon winding core 35 is fitted onto the ink ribbon winding driver axle 23.

Once a printing instruction is input to the printer 1, the printing medium M is drawn out from the tape core 32 by the rotation of the platen roller 21. Here, the ink ribbon winding driver axle 23 rotates in sync with the platen roller 21 so that the ink ribbon R is drawn out from the ink ribbon supply core 34 in unison with the printing medium M. In this way, the printing medium M and the ink ribbon R are conveyed along in an overlapping manner. Then, the thermal head 10 heats the ink ribbon R as it passes between the thermal head 10 and the platen roller 21 in order to transfer the ink onto the printing medium M and thereby print an image based on data representing printing content to be formed on the printing medium M (hereinafter, "printing data").

The used ink ribbon R that has passed between the thermal head 10 and the platen roller 21 is then wound around the ink ribbon winding core 35. Meanwhile, the printed printing medium M that has passed between the thermal head 10 and the platen roller 21 is cut by a full-cutting mechanism 16 or a half-cutting mechanism 17 (described later) and then fed out through the feedout port 2*a*.

Figure 5:
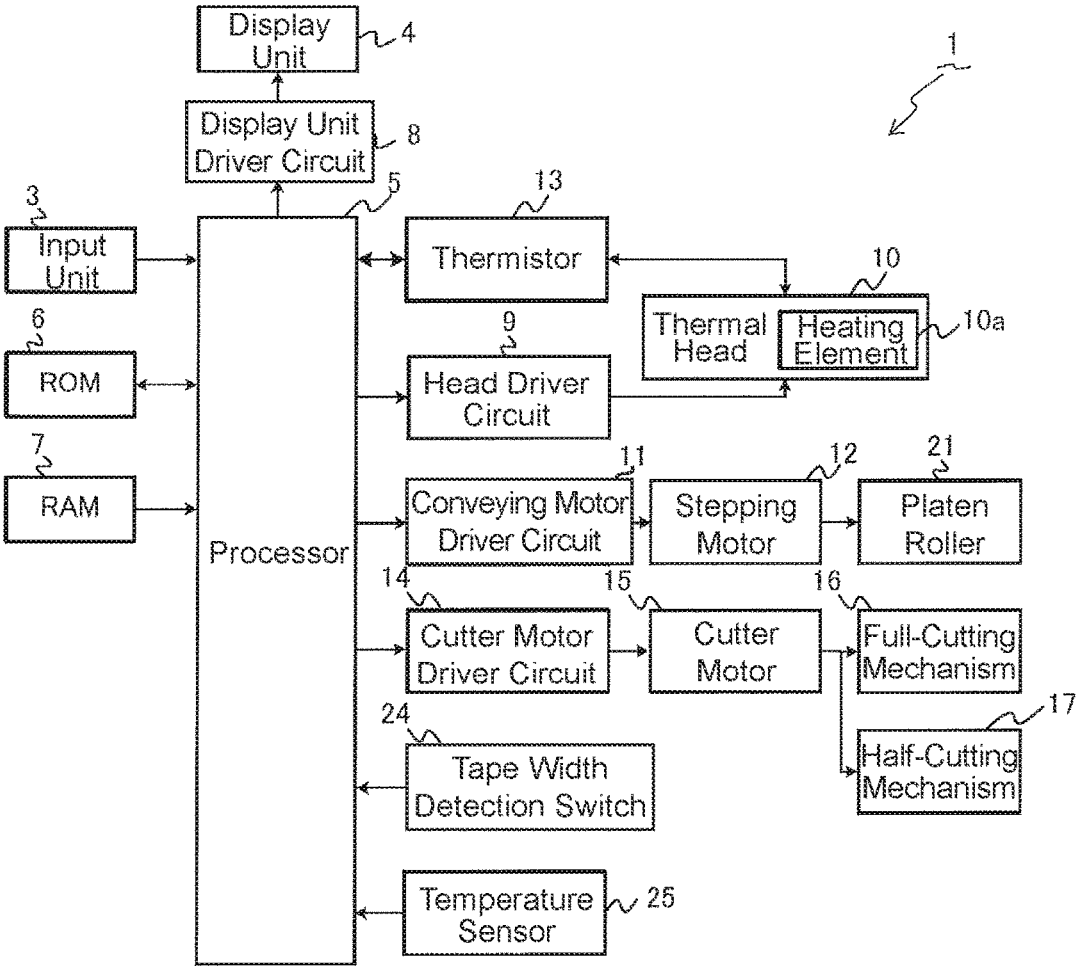
FIG. 5 is a control block diagram of the printer according to the embodiment.

FIG. 5 is a control block diagram of the printer 1.

The printer 1 includes, in addition to the input unit 3, the display unit 4, the thermal head 10, the full-cutting mechanism 16, the half-cutting mechanism 17, the platen roller 21, and the tape width detection switches 24 described above, a processor 5, a read-only memory (ROM) 6, a random-access memory (RAM) 7, a display unit driver circuit 8, a head driver circuit (heat head driver circuit) 9, a conveying motor driver circuit 11, a stepping motor 12, a cutter motor driver circuit 14, a cutter motor 15, and a temperature sensor 25. Here, the processor 5, the ROM 6, and the RAM 7 are an example of a computer of the printer 1.

The processor 5 includes a central processing unit (CPU) or the like, for example, and loads programs stored into the ROM 6 to the RAM 7 and then executes those programs in order to control the operation of the components of the printer 1.

The processor 5 generates a strobe signal (a control signal) and print line data, for example, and supplies these to the head driver circuit 9. In this way, the processor 5 controls, via the head driver circuit 9, how current is passed through a plurality of heating elements 10*a* of the thermal head 10. The processor 5 also controls the platen roller 21 via the conveying motor driver circuit 11 and the stepping motor 12. Furthermore, the processor 5 controls the full-cutting mechanism 16 and the half-cutting mechanism 17 via the cutter motor driver circuit 14 and the cutter motor 15.

Figure 6:
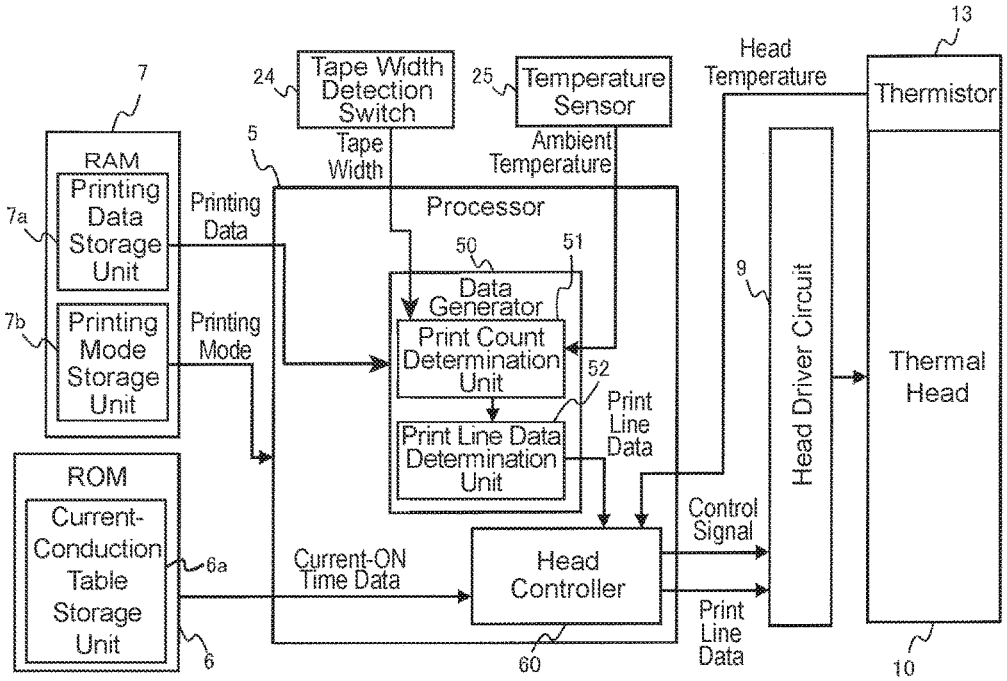
FIG. 6 is a control block diagram of a specific example of a processor of the printer according to the embodiment.

As illustrated in FIG. 6, the ROM 6 includes a current-conduction table storage unit 6*a* which stores a current-conduction table, for example. Moreover, the ROM 6 stores printing programs for printing on the printing medium M, and various types of data (such as fonts, for example) needed to execute the printing programs. Furthermore, the ROM 6 also functions as a storage medium which stores programs readable by the processor 5.

As illustrated in FIG. 6, the RAM 7 includes a printing data storage unit 7*a* which stores printing data and a printing mode storage unit 7*b* which stores printing modes. The RAM 7 also functions as a data memory which stores information about printing as well as display data for the display unit 4.

The display unit driver circuit 8 controls the display unit 4 in accordance with the display data stored in the RAM 7. Under the control of the display unit driver circuit 8, the display unit 4 may display the printing content in a manner which makes the progress of the printing process visible, for example.

The head driver circuit 9 drives the thermal head 10 on the basis of the strobe signal and the print line data supplied from the processor 5. More specifically, while the strobe signal is ON (hereinafter, the "current-ON control period"), the head driver circuit 9 enables or disables the flow of current to be supplied to the plurality of heating elements 10*a* of the thermal head 10 in accordance with the printing content.

The thermal head 10 includes the plurality of heating elements 10*a*, which are arranged in a primary direction (the width direction of the printing medium M). In the current-ON control period of the strobe signal supplied from the processor 5, the head driver circuit 9 selectively passes current to be supplied to the heating elements 10*a* in accordance with the printing data, thereby causing the heating elements 10*a* to generate heat and apply that heat to the ink ribbon R. In this way, the thermal head 10 prints print lines on the printing medium M one line at a time by means of thermal transfer.

The conveying motor driver circuit 11 drives the stepping motor 12. The stepping motor 12 drives the platen roller 21 and is an example of a conveying motor for conveying the printing medium M. The platen roller 21 is an example of a conveyor which rotates using the power supplied by the stepping motor 12 in order to convey the printing medium M in the lengthwise direction of that printing medium M (secondary direction; the conveyance direction D illustrated in FIG. 4).

The cutter motor driver circuit 14 drives the cutter motor 15. The full-cutting mechanism 16 and the half-cutting mechanism 17 operate using the power supplied by the cutter motor 15 to make full cuts or half cuts in the printing medium M. Here, a "full cut" refers to cutting through both the base material Ma and the release paper Mb (see FIG. 2) of the printing medium M in the width direction, while a "half cut" refers to cutting through just the base material Ma in the width direction.

The temperature sensor 25 is an example of an ambient temperature measuring unit which measures the ambient temperature of the environment surrounding the printer 1.

In the printer 1 configured as described above, an image based on the printing data to be printed on the printing medium M by the thermal head 10 is constituted by a plurality of print lines which each extend in the direction orthogonal to the conveyance direction D and are arranged adjacent to one another in that conveyance direction D. Moreover, when printing a single print line, attempting to pass current through the heating elements 10*a* of the thermal head 10 at the same time could potentially exceed the current capacity of the power adapter which applies voltage to the thermal head 10.

Therefore, when the width of the printing medium M is large, for example, and the number of heating elements 10*a* through which current will be passed in accordance with the printing data in order to print a single print line exceeds a prescribed number, the printer 1 divides those heating elements 10*a* through which current will be passed into a plurality of groups and then utilizes a divided printing scheme to print that print line by printing multiple times in a time-divided manner for each group. Here, the number of prints performed on a per-group basis in this divided printing scheme will be referred to as "print count". In other words, the processor 5 controls the thermal head 10 so as to print each print line using a print count corresponding to the number of print dots included in that print line. Note that here, a "print line" refers to a line to be printed on the printing medium M. Moreover, "print dots" refers to each of a plurality of dots constituting each print line, where each print dot corresponds to one of the heating elements 10*a* through which current is passed.

This type of variable division printing scheme in which print count is changed makes it possible to increase printing speed (conveying speed) as much as is possible without increasing the current capacity of the power adapter. This scheme also makes it possible to inhibit decreases in print quality or deterioration in the durability of the thermal head 10 resulting from overheating of the thermal head 10.

The time required for printing is different when printing a print line all at once (hereinafter, "one-time printing") and when printing several separate times (hereinafter, "divided printing"), with one-time printing making it possible to print each print line in a shorter period of time. Therefore, the printer 1 is configured to convey the printing medium M at a higher speed for one-time printing than for divided printing. More specifically, the printer 1 is configured to convey the printing medium M at different conveying speeds for different print counts, for example.

FIG. 6 is a control block diagram of a specific example of the processor 5 of the printer 1.

The processor 5 includes a data generator 50 and a head controller 60. Here, the data generator 50 and the head controller 60 may respectively be constituted by dedicated circuits or may be implemented by executing programs stored in the ROM 6.

The data generator 50 includes a print count determination unit 51 which determines the print count for each print line, and a print line data determination unit 52 which, on the basis of the printing data, determines print line data specifying which heating elements 10*a* need to generate heat while printing the print line. Here, the printing data used by the print line data determination unit 52 is read from the printing data storage unit 7*a* of the RAM 7.

The print count determination unit 51 sets, on the basis of the number of heating elements 10*a* through which current will be passed in accordance with the printing data, the print count for when printing print lines in a period (hereinafter, a "normal operation period") following a period (hereinafter, a "control period") of printing a prescribed number of print lines after the thermal head 10 starts printing such that the print count for when printing print lines in the control period is set to be greater than the print count in the normal operation period, for any printing data. For example, when the width of the printing medium M is less than or equal to a prescribed width, the print count determination unit 51 controls the print count for printing print lines in the control period following the start of printing so as to be greater than the print count for printing print lines in the normal operation period, and when the width of the printing medium M exceeds the prescribed width, this control process is not performed.

Figure 8:
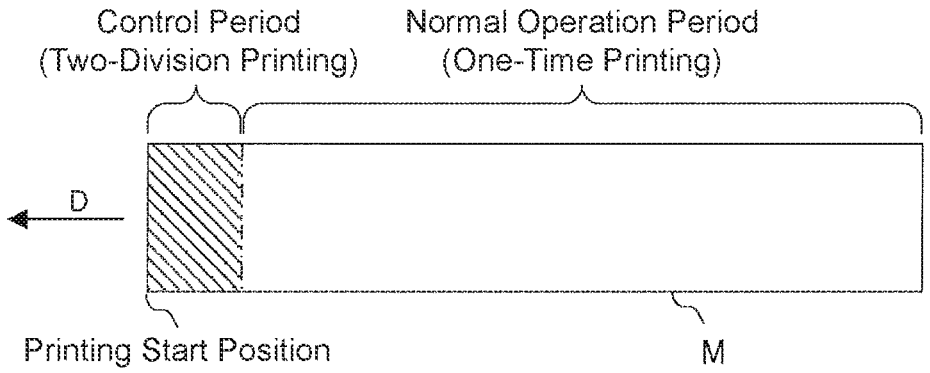
FIG. 8 is a drawing for explaining the concept of print count per print line in the embodiment.

As illustrated by the printing medium M in FIG. 8, one example of setting the print count for print lines in the control period following the start of printing to be greater than the print count for print lines in the subsequent normal operation period is to set the print count to two for a prescribed number of print lines which corresponds to the control period and are included in a 1 mm region, for example, starting from the printing start position, and to set the print count to one for print lines included in a region corresponding to the normal operation period. Note, however, that even for print lines for which the print count is originally determined to be two, if the number of print dots is less than a prescribed number, for example, the print count may be set to one. Similarly, even for print lines for which the print count is originally determined to be one, if the number of print dots is greater than a prescribed number which is different from the abovementioned prescribed number, for example, the print count may be set to two.

In regards to the width of the printing medium M being less than or equal to a prescribed width, if the thermal head 10 can utilize one-time printing when the width of the printing medium M is less than or equal to 18 mm (e.g., 3.5 mm, 6 mm, 9 mm, 12 mm, or 18 mm), for example, the prescribed width is preferably to be set to 18 mm. If, in a state where the temperature of the thermal head 10 is low due to being equal to the ambient temperature or a temperature near the ambient temperature, for example, a one-time printing process using several of the heating elements 10*a* is performed when starting to print, the decrease in temperature which occurs after the thermal head 10 reaches a high temperature tends to be relatively large, which can cause a sticking phenomenon in which the ink ribbon R adheres to the thermal head 10 across the entire width direction of the printing medium M. However, in states in which one-time printing can be used, increasing the print count when starting to print makes it possible to reduce the occurrence of sticking.

Moreover, in regards to setting the print count for print lines in the control period following the start of printing to be greater than the print count for print lines in the normal operation period, the narrower the width of the printing medium M (and the ink ribbon R) is, the stronger the pulling force is applied to the ink ribbon R if sticking has occurred at the time of start of printing. Therefore, the narrower the width of the printing medium M is, the longer the control period should be by increasing the number of print lines (that is, the prescribed number of print lines described above) for which the print count is increased. Furthermore, the lower the ambient temperature is, the larger the abovementioned decrease in temperature becomes, which makes sticking more likely to occur. Therefore, the lower the ambient temperature measured by the temperature sensor 25 is, the longer the control period should be by increasing the number of print lines (that is, the prescribed number of print lines described above) for which the print count is increased. In addition, for narrower widths of the printing medium M or lower ambient temperatures, the print count itself for the prescribed number of print lines following the start of printing may be further increased. Moreover, as time elapses after printing starts, the amount of heat stored in the thermal head or a cooler for the thermal head increases, and therefore the temperature decrease that occurs when switching from a current-ON period to a current-OFF period becomes less than when printing starts. Furthermore, as time elapses after printing starts, the printing medium M and the ink ribbon R come to be conveyed at substantially the same steady-state speed, and therefore acceleration of the ink ribbon R decreases, and the abovementioned pulling force that occurs after sticking has occurred also becomes less than when printing starts and the ink ribbon R is in a static state. Thus, in the present embodiment, the print count for print lines in the control period following the start of printing is increased to be greater than the print count for print lines in the normal operation period, thereby reducing the occurrence of sticking when printing starts.

Figure 9A:
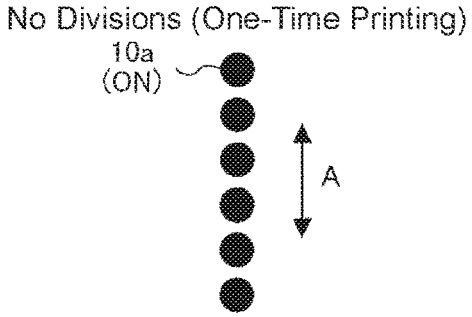
FIG. 9A is a drawing for explaining a current-conducting state of heating elements when one-time printing a print line in the embodiment.
Figure 9B:
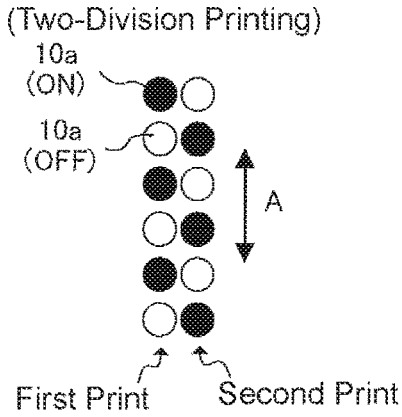
FIG. 9B is a drawing for explaining a current-conducting state of the heating elements when two-division printing a print line in the embodiment.
Figure 9C:
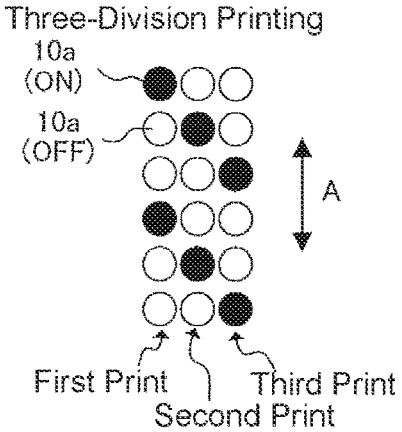
FIG. 9C is a drawing for explaining a current-conducting state of the heating elements when three-division printing a print line in the embodiment.

It is preferable that the print line data determination unit 52 determine the print line data such that for print lines for which multiple prints are performed, the heating elements 10*a* (print dots) that generate heat in each print among those multiple prints are positioned in a dispersed manner in an arrangement direction A (see FIGS. 9A to 9C). Here, "dispersed" refers to a state different from a state in which the heating elements 10*a* which generate heat among a plurality of heating elements 10*a* arranged in the primary direction (the width direction of the printing medium M; the arrangement direction A) are aggregated together adjacent to one another in the arrangement direction A for each printing incident (for example, a state in which of the heating elements 10*a*, which print the first time, are aggregated together adjacent to one another on one side in the primary direction, and the heating elements 10*a*, which print the second time, are positioned together adjacent to one another on the other side in the primary direction). Moreover, with respect to print line data, in which the current-conducting state of all of the heating elements 10*a* is set to ON (the black circles) as illustrated in FIG. 9A, which can be printed without using divided printing (the print count of one), when two-division printing with the print count of two is to be used, it is preferable that the print line data determination unit 52 determine the print line data such that the heating elements 10*a* that generate heat in the first print and the heating elements 10*a* that generate heat in the second print are arranged alternately in the arrangement direction A, as illustrated in FIG. 9B. As illustrated in FIG. 9C, when three-division printing with the print count of three is used, it is preferable that the print line data determination unit 52 determine the print line data such that the heating elements 10*a* that generate heat in the first print, the heating elements 10*a* that generate heat in the second print, and the heating elements 10*a* that generate heat in the third print are arranged alternately in the arrangement direction A. Note that the white circles in FIGS. 9B and 9C represent heating elements 10*a* for which the current-conducting state is set to OFF. Here, although one-time printing can be used instead of divided printing when only some of the heating elements 10*a* generate heat for a print line instead of all of the heating elements 10*a* generating heat as illustrated in FIG. 9A, even if the print count per print line in the control period following the start of printing is increased independently of the printing content (the number of print dots), potential disadvantages such as an increase in printing time do not become substantially problematic. Therefore, it is simple to use divided printing for any printing content, and doing so also acts as a safety measure for preventing breakage of the ink ribbon R. Furthermore, even when only some of the heating elements 10*a* generate heat for a print line, it is simple for the print line data determination unit 52 to determine the positioning of the heating elements 10*a* which should generate heat in each print so as to achieve positional relationships same as when all of the heating elements 10*a* generate heat for a print line as described above.

The head controller 60 generates the strobe signal (a control signal specifying the current-ON control period) and outputs that signal to the head driver circuit 9. More specifically, the head controller 60 calculates a current-ON time on the basis of current-ON time data read from the current-conduction table storage unit 6*a* of the ROM 6 and the head temperature measured by the thermistors 13. Then, a strobe signal (control signal) corresponding to this current-ON time as well as the print line data determined by the print line data determination unit 52 are output to the head driver circuit 9. Note that here, "current-ON time" refers to the duration of the current-ON control period.

The processor 5 controls the stepping motor 12 in accordance with printing modes set on the printer 1 and stored in the printing mode storage unit 7*b*. Here, the printing modes include a high-resolution mode in which print quality is prioritized and a high-speed mode in which printing speed is prioritized, for example, and are set via the input unit 3 described above. Moreover, the conveying speed of the printing medium M achieved by the stepping motor 12 is set so as to be slower as the print count increases and so as to be slower in the high-resolution mode than in the high-speed mode.

Figure 7:
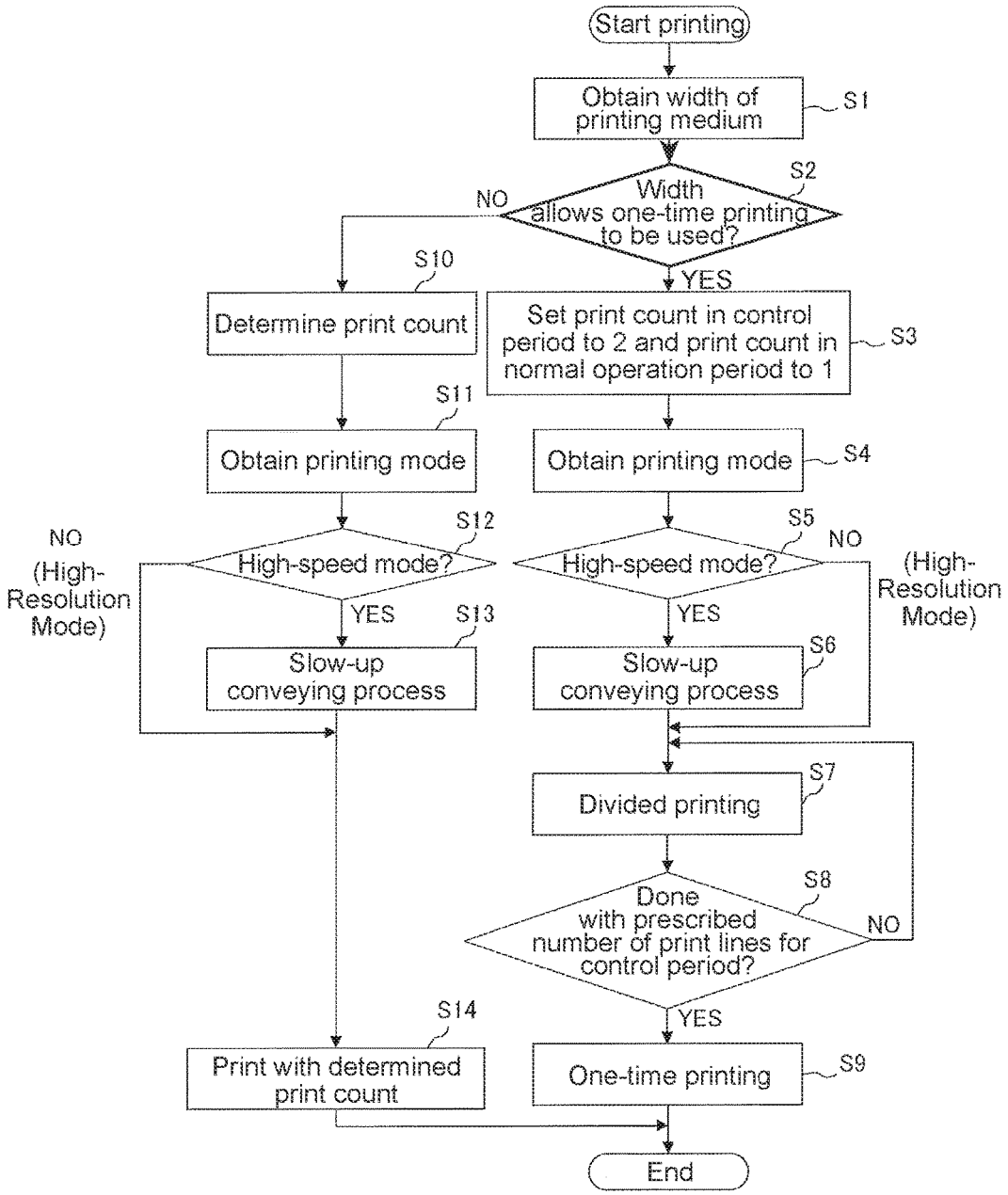
FIG. 7 is a flowchart for explaining a method of printing control according to the embodiment.

FIG. 7 is a flowchart for explaining the method of printing control according to the present embodiment.

Next, processes performed by the processor 5 will be described in detail with reference to FIG. 7. In the printer 1, when an instruction to start a printing process is received via the input unit 3, the processor 5 executes a printing program to start the printing control process illustrated in FIG. 7.

First, the processor 5 obtains the width of the printing medium M on the basis of the signal from the tape width detection switches 24 (step S1).

Next, the print count determination unit 51 determines whether the width of the printing medium M is less than or equal to a width that allows the thermal head 10 to use one-time printing (an example of a prescribed width) (step S2). Here, to determine this width that allows one-time printing to be used, it can be determined whether the width of the printing medium M is such that a set of the heating elements 10*a* that corresponds to the threshold current capacity of the AC adapter is capable of performing one-time printing on the printing medium M across the entire width.

If it is determined that the width of the printing medium M is less than or equal to the width that allows one-time printing to be used (YES in step S2), the print count determination unit 51 determines print counts such that the print count for the prescribed number of print lines in the control period from the start of printing is greater than the print count for print lines in the normal operation period (step S3). For example, the print count determination unit 51 sets the print count for print lines in the control period to two, which is greater than the print count of one for the normal operation period. Meanwhile, if the printing medium M exceeds the width that allows one-time printing to be used (NO in step S2), the print count determination unit 51 determines the print count for print lines on the basis of the printing data (and determines a print count of two, for example) (step S10). Then, for the print lines for which the print count is two, the print line data determination unit 52 determines print line data on the basis of the printing data as illustrated in FIG. 9B described above, for example.

After the print count determination process (step S3 or S10), the processor 5 obtains the printing mode set via the input unit 3 or the like of the printer 1 and stored in the printing mode storage unit 7*b* (step S4 or S11) and then determines whether the printing mode is the high-speed mode (step S5 or S12).

If it is determined that the printing mode is the high-speed mode (YES in step S5 or S12), the processor 5 controls the stepping motor 12 so as to perform a slow-up conveying process in which the speed is increased from a low-speed state to a high-speed state in a step-by-step manner (step S6 or S13). This slow-up conveying process is performed when the stepping motor 12 cannot be immediately set to the high-speed state (such as 40 mm/s). Moreover, this slow-up conveying process is performed at the same time as the printing processes (steps S7 and S9, or step S14) described below. It is preferable that the processor 5 reference a prescribed table to get a conveying speed (printing speed) corresponding to the print count and the printing mode. Furthermore, the conveying speed (printing speed) of the printing medium M achieved by the stepping motor 12 is set so as to be slower as the print count increases and so as to be slower in the high-resolution mode than in the high-speed mode. In addition, the conveying speed may be determined on the basis of factors such as the head temperature obtained from the thermistors 13 or the ambient temperature obtained from the temperature sensor 25.

After it is determined that the printing mode is the high-resolution mode rather than the high-speed mode (NO in step S5 or S12), the conveying state is kept as is in the low-speed state rather than performing the slow-up conveying process (of step S6 or S13). Moreover, in the low-speed state, the conveying speed differs depending on the print count and is set to a speed such as 10 mm/s when the print count is two and to a speed such as 20 mm/s when the print count is one, for example. Similarly, in the high-speed state, the conveying speed also differs depending on the print count and is set to a speed such as 20 mm/s when the print count is two and to a speed such as 40 mm/s when the print count is one, for example.

Next, if the process (step S3) of setting the print count to two for print lines in the control period following the start of printing has been performed, the head controller 60 outputs a strobe signal (control signal) corresponding to the current-ON time and the print line data determined by the print line data determination unit 52 to the head driver circuit 9. Then, the head driver circuit 9 drives the thermal head 10 on the basis of the print line data and the strobe signal supplied from the processor 5 so as to perform divided printing with a print count of two until the printing of the print lines for the control period is completed (steps S7 and S8).

Once the printing process for the control period is complete, one-time printing with a print count of one for each print line is performed using the same control processes described above (step S9). Meanwhile, if the process (step S3) of setting the print count to two for the control period following the start of printing was not performed (No in step S2), a process of printing with a print count determined for each print line is performed using the same control processes described above (step S14). Note that although FIG. 7 depicts an example in which when the printing medium M has a width that allows one-time printing to be used, the print count is two for the control period following the start of printing while the print count is one for other print lines, these print counts may simply be used as a base case, and then the print count may be increased or decreased in accordance with the content of the printing data. For example, as described above, even for print lines for which the print count is originally determined to be two, if the number of print dots is less than a prescribed number, for example, the print count may be set to one.

Figure 10:
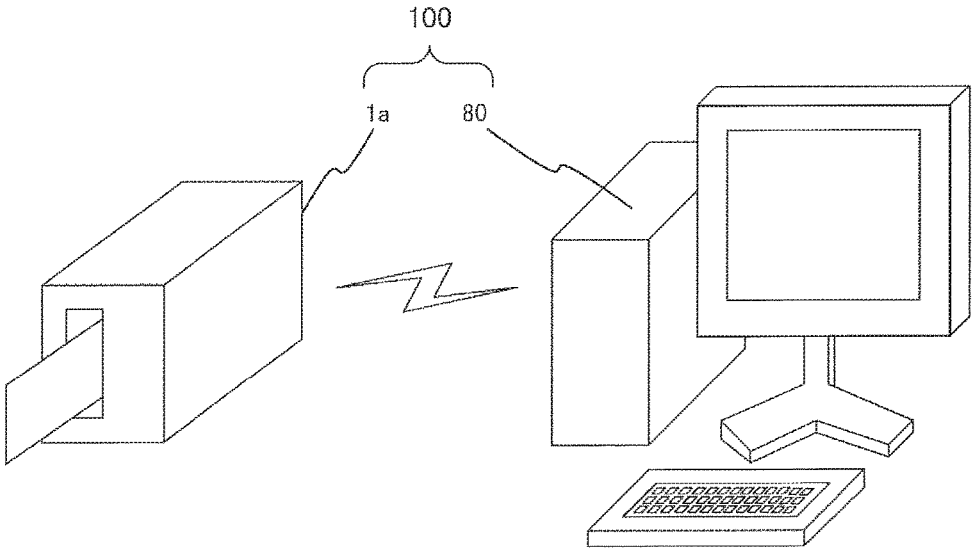
FIG. 10 is a perspective view illustrating a printing system according to a modification example of the embodiment.

FIG. 10 is a perspective view illustrating a printing system 100 according to a modification example of the present embodiment.

Figure 11:
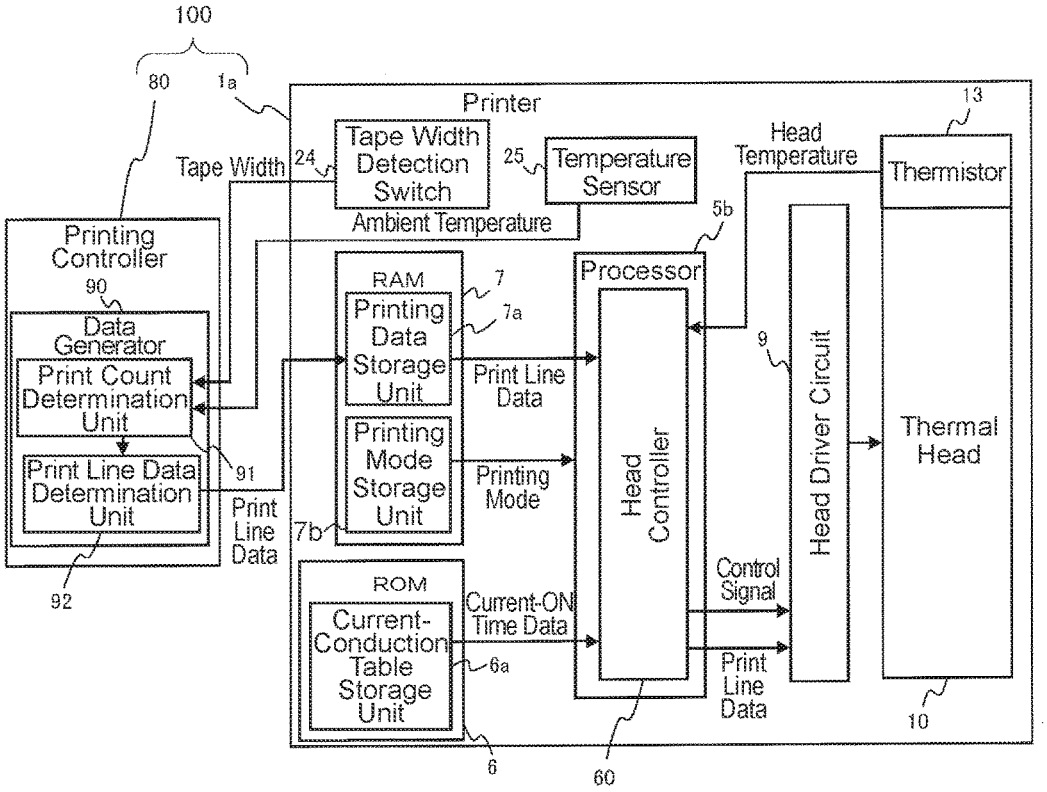
FIG. 11 is a control block diagram illustrating a processor of the printing system according to the modification example of the embodiment.

FIG. 11 is a control block diagram illustrating a processor 5*b* of the printing system 100 according to this modification example.

The printing system 100 illustrated in FIGS. 10 and 11 includes a printing controller 80 and a printer 1*a*. The printing controller 80 is a general-purpose computer, for example, and includes a processor, memory, storage, and the like. The printing system 100 is different from the printer 1 in that some of the processes of the printer 1 described above are performed by the printing controller 80.

The printing controller 80 includes a data generator 90 which functions the same as the data generator 50 of the printer 1 and which is implemented by having the processor execute a program. The data generator 90 includes a print count determination unit 91 which functions the same as the print count determination unit 51 of the printer 1 and a print line data determination unit 92 which functions the same as the print line data determination unit 52 of the printer 1. In other words, the printing controller 80 is configured to determine print count using the print count determination unit 91, to determine print line data on the basis of the determined print count, and to output this print line data to the printer 1*a* (more specifically, to a printing data storage unit 7*a* thereof).

The printer 1*a* is different from the printer 1 in that the printer 1*a* includes a processor 5*b* instead of the processor 5. The processor 5*b* includes the head controller 60 but does not include the data generator 50. Therefore, in the printer 1*a*, the processor 5*b* controls the head driver circuit 9 on the basis of the print line data stored in the printing data storage unit 7*a*.

In the embodiments as described above, the printer 1 and the printing system 100 include the thermal head 10 which has the plurality of heating elements 10*a* and prints a plurality of print lines on the printing medium M, and the print count determination unit 51 (91) which determines the print count for each print line. The print count determination unit 51 (91) determines print count such that the print count for the control period following the start of printing by the thermal head 10 is greater than the print count for print lines in the normal operation period.

This simple control scheme of increasing the print count for print lines in the control period following the start of printing makes it possible to mitigate rapid heating of the thermal head 10 when printing starts from a state in which the thermal head 10 or a cooler such as a heat sink for cooling the thermal head 10 have not yet accumulated any heat. This avoids the rapid cooling of the thermal head 10 which would otherwise occur after this rapid heating due to the lack of stored heat, thereby making it possible to reduce occurrence of the sticking phenomenon which tends to occur when the temperature of the thermal head rapidly decreases from a high-temperature state to a low-temperature state. Moreover, although accelerating the ink ribbon R in order to start moving the ink ribbon R from a static state when printing starts causes a relatively large pulling force to be applied to the ink ribbon R, increasing the print count for print lines in the control period following the start of printing reduces the conveying speed of the printing medium M, thereby making it possible to reduce this pulling force. Thus, the present embodiments make it possible to prevent breakage of the ink ribbon R using a simple control scheme.

Moreover, in the present embodiments, the printer further includes the print line data determination unit 52 (92), which determines, on the basis of the printing data, print line data specifying which heating elements 10*a* need to generate heat while printing a print line. This print line data determination unit 52 (92) determines the print line data such that for print lines for which multiple prints are performed, the heating elements 10*a* that generate heat in each print among those multiple prints are positioned in a dispersed manner. It is more preferable that the print line data determination unit 52 (92) determine the print line data such that for print lines for which multiple prints are performed, the heating elements 10*a* that generate heat in each print among those multiple prints are arranged alternately. This results in the heating elements 10*a* that generate heat being positioned in a dispersed manner in the width direction of the printing medium M, thereby making it possible to reduce the occurrence of sticking relative to when several of the heating elements 10*a* that generate heat are closely grouped, which in turn makes it possible to much more reliably prevent breakage of the ink ribbon R.

In addition, in the present embodiments, the printer 1 (printer system 100) further includes the tape width detection switches 24, which are an example of a width detector for detecting the width of the printing medium M. Moreover, when the width of the printing medium M is less than or equal to a prescribed width, the print count determination unit 51 (91) determines print count such that the print count for print lines in the control period following the start of printing by the thermal head 10 is greater than the print count for print lines in the subsequent normal operation period. Therefore, in comparison to when using one-time printing on the printing medium M, which causes rapid heating of the thermal head and thus makes sticking more likely to occur, increasing the print count mitigates rapid heating of the thermal head 10 and ultimately makes it possible to reduce the occurrence of sticking. This, in turn, makes it possible to much more reliably prevent breakage of the ink ribbon R. Furthermore, the narrower the width of the printing medium M is, the stronger the pulling force applied to printing medium M and the ink ribbon R is when starting to print after sticking has occurred. Therefore, reducing the occurrence of sticking makes it possible to reduce this pulling force, which again makes it possible to much more reliably prevent breakage of the ink ribbon.

Although an embodiment of the present invention was described above, the invention of the present application includes all inventions within the scope of the claims and their equivalents.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A printer, comprising:

a thermal head having a plurality of heating elements to print an image constituted of a plurality of print lines on a printing medium line by line on the basis of printing data;

a processor; and a width detector that detects a width of the printing medium, wherein the processor performs the following:

defining a control period from a start of printing and a normal period after the control period; and controlling the thermal head such that:

in the control period, for any printing data, the thermal head performs a division printing for each of the print lines that are to be printed in the control period, the division printing being such that for each print line to be printed, the plurality of heating elements are divided into a plurality of subgroups and the respective subgroups of the heating elements are activated in a time-divided manner;

in the normal period, the thermal head performs a non-division printing for at least some of the print lines that are to be printed in the normal period, the non-division printing being such that for each print line to be printed, corresponding heating elements of the thermal head are activated at once; and when the width of the printing medium is detected to be less than or equal to a width corresponding to a maximum number of the heating elements that can pass current all at once in the printer, in the control period, the thermal head performs the division printing to print each of the print lines that are to be printed in the control period, and, in the normal period, the thermal head performs the non-division printing to print each of the print lines that are to be printed in the normal period by the non-division printing.

2. The printer according to claim 1, wherein in the normal period, the processor controls the thermal head based on the printing data such that the thermal head also performs the division printing for some of the print lines that are not subject to the non-division printing.

3. The printer according to claim 1, wherein in the division printing in the control period, the plurality of subgroups of heating elements are grouped such that the heating elements belonging to the respective subgroups are dispersed in position among the subgroups along an arrangement direction of the plurality of heating elements.

4. The printer according to claim 3, wherein in the division printing in the control period, the plurality of subgroups of heating elements are grouped such that the heating elements belonging to the respective subgroups are arranged alternately relative to one another in the arrangement direction.

5. The printer according to claim 1, wherein the control period is a period of printing a prescribed number of print lines after the thermal head starts printing.

6. A printing system, comprising:

a printer; and a printing controller, wherein the printer includes a thermal head having a plurality of heating elements to print an image constituted of a plurality of print lines on a printing medium line by line on the basis of printing data, and a width detector that detects a width of the printing medium, and wherein the printing controller performs the following:

defining a control period from a start of printing and a normal period after the control period; and controlling the thermal head such that:

in the control period, for any printing data, the thermal head performs a division printing for each of the print lines that are to be printed in the control period, the division printing being such that for each print line to be printed, the plurality of heating elements are divided into a plurality of subgroups and the respective subgroups of the heating elements are activated in a time-divided manner;

in the normal period, the thermal head performs a non-division printing for at least some of the print lines that are to be printed in the normal period, the non-division printing being such that for each print line to be printed, corresponding heating elements of the thermal head are activated at once; and when the width of the printing medium is detected to be less than or equal to a width corresponding to a maximum number of the heating elements that can pass current all at once in the printer, in the control period, the thermal head performs the division printing to print each of the print lines that are to be printed in the control period, and, in the normal period, the thermal head performs the non-division printing to print each of the print lines that are to be printed in the normal period by the non-division printing.

7. A method of printing control performed by a processor in a printer including said processor, a width detector that detects a width of a printing medium, and a thermal head having a plurality of heating elements, or by a printing controller that controls a printer including a thermal head having a plurality of heating elements, and a width detector that detects a width of a printing medium, to print an image constituted of a plurality of print lines on the printing medium line by line on the basis of printing data, the method comprising:

defining a control period from a start of printing and a normal period after the control period; and controlling the thermal head such that:

in the control period, for any printing data, the thermal head performs a division printing for each of the print lines that are to be printed in the control period, the division printing being such that for each print line to be printed, the plurality of heating elements are divided into a plurality of subgroups and the respective subgroups of the heating elements are activated in a time-divided manner;

in the normal period, the thermal head performs a non-division printing for at least some of the print lines that are to be printed in the normal period, the non-division printing being such that for each print line to be printed, corresponding heating elements of the thermal head are activated at once; and when the width of the printing medium is detected to be less than or equal to a width corresponding to a maximum number of the heating elements that can pass current all at once in the printer, in the control period, the thermal head performs the division printing to print each of the print lines that are to be printed in the control period, and, in the normal period, the thermal head performs the non-division printing to print each of the print lines that are to be printed in the normal period by the non-division printing.

8. A non-transitory computer-readable storage medium having stored thereon a program executable by a processor in a printer including said processor, a width detector that detects a width of a printing medium, and a thermal head having a plurality of heating elements, or by a printing controller that controls a printer including a thermal head having a plurality of heating elements, and a width detector that detects a width of a printing medium, to print an image constituted of a plurality of print lines on the printing medium line by line on the basis of printing data, the program causing the processor or the printing controller to perform the following:

defining a control period from a start of printing and a normal period after the control period; and controlling the thermal head such that:

in the control period, for any printing data, the thermal head performs a division printing for each of the print lines that are to be printed in the control period, the division printing being such that for each print line to be printed, the plurality of heating elements are divided into a plurality of subgroups and the respective subgroups of the heating elements are activated in a time-divided manner;

in the normal period, the thermal head performs a non-division printing for at least some of the print lines that are to be printed in the normal period, the non-division printing being such that for each print line to be printed, corresponding heating elements of the thermal head are activated at once; and when the width of the printing medium is detected to be less than or equal to a width corresponding to a maximum number of the heating elements that can pass current all at once in the printer, in the control period, the thermal head performs the division printing to print each of the print lines that are to be printed in the control period, and, in the normal period, the thermal head performs the non-division printing to print each of the print lines that are to be printed in the normal period by the non-division printing.

* * * * *